US005570747A

United States Patent [19]

Cordry

[11] Patent Number: 5,570,747

[45] Date of Patent: Nov. 5, 1996

[54] DRIVE POINT DEVICE

[76] Inventor: Kent E. Cordry, 308 Mountaire Pkwy., Clayton, Calif. 94517

[21] Appl. No.: 418,144

[22] Filed: Apr. 5, 1995

Related U.S. Application Data

[63] Continuation-in-part of Ser. No. 206,000, Mar. 4, 1994, Pat. No. 5,449,045.

[51] Int. Cl.[6] ..... E21B 7/20

[52] U.S. Cl. ..... 175/20; 175/22; 166/157

[58] Field of Search ..... 175/19, 20, 21, 175/22, 23, 59, 314; 166/157, 254, 264; 248/156; 405/253, 254

[56] References Cited

U.S. PATENT DOCUMENTS

| | | | |
|---|---|---|---|
| 58,479 | 10/1866 | Rhoades . | |
| 58,721 | 10/1866 | Duck et al. . | |
| 58,769 | 10/1866 | Bruen . | |
| 64,192 | 4/1867 | Budd | 175/22 |
| 73,414 | 1/1868 | Welch et al. | 175/22 |
| 73,688 | 1/1868 | Arnold | 175/22 |
| 634,312 | 10/1899 | Swaby | 175/22 |
| 894,446 | 6/1927 | McKenny | 175/22 |
| 1,211,415 | 1/1917 | Cross . | |
| 1,489,916 | 4/1924 | Blamphin . | |
| 1,514,585 | 11/1924 | Edwards . | |
| 1,998,075 | 4/1935 | Church | 255/72 |
| 2,085,972 | 7/1937 | Halliburton | 166/1 |
| 2,141,261 | 12/1938 | Clark | 166/21 |
| 2,358,089 | 9/1944 | Gere | 248/156 |
| 2,374,227 | 4/1945 | Metcalf | 23/232 |
| 2,376,366 | 5/1945 | Lawlor et al. | 23/232 |
| 2,513,944 | 7/1950 | Kessler | 175/314 |
| 2,629,444 | 2/1953 | O'Donnell | 166/157 |
| 2,870,844 | 1/1959 | Barnes | 166/165 |
| 3,367,188 | 2/1968 | Robinson | 73/425.2 |
| 4,310,057 | 1/1982 | Brame | 175/21 |
| 4,352,477 | 10/1982 | Garrett et al. | 248/156 |
| 4,438,654 | 3/1984 | Torstensson | 73/864.52 |
| 4,649,996 | 3/1987 | Kojicic et al. | 166/228 |
| 4,669,554 | 6/1987 | Cordry | 175/59 |
| 4,804,050 | 2/1989 | Kerfood | 175/20 |
| 4,807,707 | 2/1989 | Handley et al. | 175/20 |
| 5,046,568 | 9/1991 | Cordry | 175/21 |
| 5,146,988 | 9/1992 | Cordry et al. | 175/22 X |
| 5,168,765 | 12/1992 | Broussard | 73/864.74 |
| 5,186,263 | 2/1993 | Kejr et al. | 175/23 |

OTHER PUBLICATIONS

KVA Analytical Systems brochure No. 21, Apr. 1993.

Glenn M. Thompson, et al., "Soil Gas Contaminant Investigations: A Dynamic Approach," *Ground Water Monitoring Review,* Summer 1987,pp. 88–93.

*Ground Water Monitoring Review,* Winter 1990, cover page and p. 198.

GeoInsight brochure feature HydroPunch $II_{198}$ (date unknown).

Bengt–Arne Torstensson, "A New System for Ground Water Monitoring," Fall 1984, pp. 131–138.

The Earth Technology Corporation "Cone Penetrometer Testing" brochure (date unknown).

BAT Envitech, Inc. brochure entitled "BAT ® Groundwater Monitory System" (date unknown).

R. J. Summerfield, "A Probe for Sampling Mire Waters for Chemical and Gas Analysis," *Plant and Soil,* vol. 38, No. 2 (Short Communication), Apr. 1973, pp. 469–472.

Johnson Division, UOP Inc., "Johnson Watermark Stainless Steel Drive Points," SSDP (one information page).

Pp. 72 and 83 (source/date unknown) referencing D. Well Points and E. Well Clusters.

William B. Kerfoot, "A Portable Well Point Sample for Plume Tracking," Fall 1984, pp. 38–42.

K–V Associates, Inc., Analytical Systems Division, *Ground Water Monitoring Review,* Apr. 1989, pp. 61–62.

*Primary Examiner*—Frank Tsay

*Attorney, Agent, or Firm*—Christie, Parker & Hale, LLP

[57] ABSTRACT

Described is a device for driving into the ground which includes a drive point, a fluid passage section, an annular seal and an annular drive rod. The annular seal is the widest member and fits snugly in a borehole formed after the device is driven into the ground to form a seal. Specially configured drive points are also described.

23 Claims, 7 Drawing Sheets

18
22
16
14a
12a
13
20
15
11
10a 18
22
16b
30
14b
20
15
10b

DRIVE POINT DEVICE

CROSS-REFERENCE TO RELATED APPLICATION

This application is a continuation-in-part of application Ser. No. 08/206,000 filed Mar. 4, 1994, which is now U.S. Pat. No. 5,449,045 which is incorporated herein in its entirety by this reference.

FIELD OF THE INVENTION

This invention relates to a drive point device, and in particular to a device useful for underground fluid sampling, groundwater sparging, soil gas extraction, groundwater extraction or groundwater monitoring.

BACKGROUND OF THE INVENTION

Numerous devices have been proposed for groundwater sampling and monitoring, such as described in my U.S. Pat. Nos. 4,669,554 and 5,046,568. These devices are for short-term use but in some cases for geological or operational reasons it may be desirable to leave the device in the ground for reuse. In such cases, however, to reduce costs of such devices, and their use, it is desirable to be able to withdraw and reuse the drive rods after the device has been inserted into the ground without interfering with the usefulness of the device for its intended purpose. In addition, where a device is to be used for air injection, vacuum extraction or controlled sampling, it is desirable to provide a good annular seal between the device and the ground after the device is driven into the ground. It is also desirable to maintain such a seal while the drive rods are withdrawn after the drive point device has been placed in the ground.

The present invention provides a novel drive point device, means for retrofitting existing drive points, and other similar direct-push devices, such as the BAT ENVIRO PROBE sampling device, which permits reuse of the drive rods while also providing a seal between the device and the ground to facilitate air injection, vacuum extraction and groundwater sampling.

SUMMARY OF THE INVENTION

In accordance with the invention there is provided a device adapted to be inserted, e.g., driven or pushed, into the ground to create a borehole, which comprises a drive point, a fluid passage section above the drive point, sealing means, e.g. an annular sealing collar or sealing body, positionable above the intake section, either in the initial insertion of the drive point into the ground or in exposing the fluid passage section after the drive point is positioned in the ground, an annular adapter and at least one annular drive rod connected to the adapter and releasably connected to the sealing collar or body. The sealing collar or body is sized with respect to the created borehole to substantially seal it to the ground when the device is in the borehole. The fluid passage section comprises means to allow fluid to enter or leave the interior of the device below the collar and to be supplied or withdrawn to the ground surface through a conduit disposed within the device, which could also be used to accommodate sampling means. In lieu of a separate "adapter," a segment of drive rod may serve as the adapter, in which case that segment of drive rod is releasably connected directly to the sealing collar or body.

In one embodiment, an extension tube is provided adjacent the drive point which is connected to the sealing collar, either by welding or threading, an adapter (or a drive rod segment) is connected to the collar, a perforated means is disposed within the extension tube and a conduit, such as a PVC drop pipe, is disposed within the adapter and drive rod and in fluid communication with the perforated means so that fluid may pass between the perforated means and the drop pipe. In still another embodiment, a perforated pipe is provided which extends upwardly from the drive point and is connected to the sealing collar, as aforesaid. However, in this embodiment, the perforated means is a heavy-walled pipe of sufficient strength to withstand the force applied to the driving rod to drive the device into the ground. A cylindrical screen may be disposed around the perforations in the pipe to preclude dirt and other debris from clogging the pipe.

In still another embodiment, an annular seal container body is provided which extends upwardly from the drive point and which, like the sealing collar in the previous described embodiment, is sized with respect to the borehole to substantially seal the body to the ground after the device has been driven into the ground. An annular adapter is threadedly connected at its lower end to the seal container body and at its opposite end to the drive rod. In this as in all previously described embodiments, selected threaded connections are oppositely threaded so that the drive rod and adapter can be removed from the sealing collar or body by unscrewing the drive rod and releasing the adapter from the seal container body or collar and leaving the sealing collar or body in the ground with the drive point and intake section. Perforated means are disposed within the seal container body and, advantageously, may be connected to the drive point, such as by being welded or threaded thereto. A drop pipe is disposed within the drive rod which is placed in fluid communication with the fluid passage section, which in this case is by connection to the perforated means. An annular resilient sealing means may be provided for sealing around the drop pipe when the drive rod and seal container body are raised to expose the perforated means, so as to allow fluid to pass between, i.e. leave or enter, the perforated means from the borehole. The adapter described in connection with this embodiment may also be used with the other described embodiments, if desired.

To facilitate connecting the perforated pipe to the drive point, it is advantageous to provide a tapered threaded stub extending upwardly from the drive point to accommodate perforated pipes of different internal diameter. The tapered threaded stub can act to "self-thread" or "self-tap" the pipe and make the connection to the drive point. Tapered threaded stubs of different configurations, such as straight taper or stepped, threaded tapers, may be used. The latter provides still more flexibility in accommodating perforated pipes of different internal diameter.

In another embodiment the interior of the sealing collar or body may be provided with internal threads sized to self-tap the outside diameter of the drop pipe. This too may be provided in different configurations, such as a straight threaded taper or two or more stepped threaded tapers to accommodate drop pipes of different outside diameters. Additional sealing means, such as a cup seal, rod wiper or "O" rings may be provided at all threaded connections of the drop pipe to produce a substantially air-tight seal to prevent contamination to the interior of the drop pipe.

In another embodiment, a drive point is provided. The drive point comprises at one end means to penetrate the ground by application of force to cause the means to be driven or pushed into the ground. At the opposite end, a cavity is formed in the top portion of the drive point, wherein the cavity has tapered self-tapping threads on its surface for threadedly engaging a pipe.

BRIEF DESCRIPTION OF THE DRAWINGS

The above-described and other features and advantages of the invention will be more fully understood when considered in connection with the following detailed description and accompanying drawings, wherein.

DETAILED DESCRIPTION

The drive point device and various embodiments of the device and components thereof are described in the following description in conjunction with the accompanying drawings wherein like numbers refer to like parts.

Figure 1:
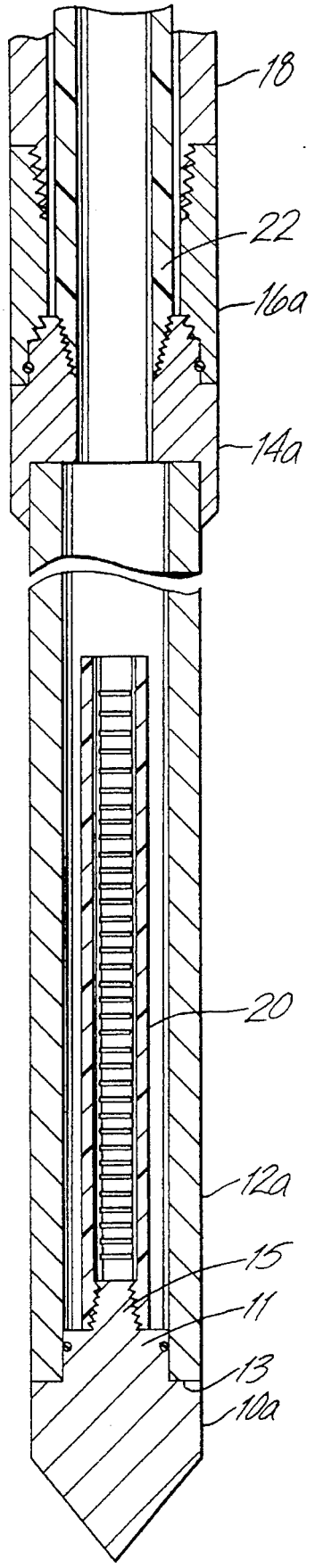
FIG. 1 is a schematic side elevation view of one embodiment of the device provided in accordance with the invention.

As shown in the drawings, referring to FIG. 1, the drive point device of the invention may advantageously employ an inexpensive drive point 10*a*, also referred to as "cone," which is at the lowermost portion of the device to facilitate driving the device into the ground, an extension tube 12*a*, sealing collar 14*a*, adapter 16*a* and annular drive rods 18. A perforated pipe 20, or the like, is disposed within the extension tube to facilitate fluid passage to and from the ground zone in which the device is driven. A drop pipe 22 is provided to be in fluid communicating relationship with the perforated pipe, in the embodiment shown as being threadedly connected thereto. An important aspect of the invention is that the device includes means for providing a substantial seal with the ground when the device is in a borehole. The sealing mechanism in the embodiment shown in FIG. 1 is a sealing collar 14*a*. The sealing collar 14*a* is releasably connected to the adapter 16*a*, such as by the threaded connection shown or by other known quick-release mechanisms. The annular drive "rod" 18 is connected to the adapter 16*a* and more than one drive rod segment may be sequentially connected to each other as necessary to drive the drive point to the desired depth in the ground. In lieu of adapter 16*a*, a drive rod segment with an oppositely threaded end may serve as an "adapter" for connection to the collar. Any suitable releasable connecting means may be employed, such as a pin and keyway or other type of connector that would permit the disconnection of the drive rod downhole. However, the presently preferred releasable connecting means is the use of reverse threads at adjacent ends of the sealing collar and adapter so that the drive rod and adapter can be released from the sealing collar by unscrewing the drive rod and thereby releasing the adapter from the sealing collar so as to isolate the collar and the fluid passage section comprising the perforated pipe located beneath the collar, which remain in the ground after the drive rods and adapter are removed following insertion and connection of the drop pipe to the perforated pipe.

As previously described, a drop pipe 22, which may be a PVC pipe or pipe made of other inexpensive material, is disposed within the drive rod 18 and is located to be in fluid-communicating relationship with the means comprising the fluid passage section of the device. If the fluid passage section comprises a perforated pipe, then the drop pipe may be connected to, or disposed adjacent the upper end of, the perforated pipe, and if the fluid passage section comprises a screen, the drop pipe can be similarly located in fluid-communicating relationship with the screen. The drop pipe 22 should be sealed in such a manner to avoid contamination to the interior of the pipe from above the fluid passage section. This may be accomplished by connecting the drop pipe to the collar as in FIG. 1, such as by threading the pipe to the collar as shown or by connecting the drop pipe to the perforated pipe in the fluid passage section.

The term "fluid passage section" as used herein is intended to refer to that portion of the device that enables passage of fluid, gas or liquid, in directions to and from, i.e. between the ground (including ground water) and the device. Thus, the device may be used to withdraw fluid, e.g. for sampling, etc., or for introducing pressurized fluid to the ground.

An important aspect of the invention is that it is possible to leave the fluid passage section within the borehole while removing the drive rod after the device has been placed in proper position within the ground. Properly sizing the internal diameter of the drive rod to be used enables a smaller-diameter, less-expensive drop pipe to be run inside the drive rod and connected, e.g. threaded, to the adapter or collar or to the perforated means directly. After the internal pipe is connected, the drive rod(s) may be disconnected and removed, leaving the drop pipe to provide a fluid-passing connection between the intake section and the ground surface. The sealing collar provides a tight annular seal for sparging or soil gas and groundwater removal.

Where desired, a grout seal can be placed inside the drive rod but outside the drop pipe as the drive rod is removed. This is another way of providing a seal between the drop pipe and the surface.

To seal the device to the ground, the sealing collar has an enlarged diameter and is sized so that a substantial seal is formed between the collar and the ground, i.e. lateral surfaces of the borehole formed by driving the device into the ground. In other words, the outside diameter of the sealing collar is not less than the outer diameter of the other components of the device.

In the embodiment illustrated, the drive point includes a centrally extending stub 11 which leaves a shoulder 13 around the perimeter of the drive point into which the extension tube 12*a* is fitted. Also shown in this embodiment is a stub that terminates in a tapered threaded portion 15. The tapered threaded portion provides an excellent means for connecting the perforated pipe to the drive point and is able to accommodate pipes of different internal diameters. The threads also allow a plastic pipe to "self-thread" or "self-tap" and form a sealed connection to the drive point, thereby allowing the fluid-passing contact zone with the ground to be controlled by controlling the positioning of the perforations.

Figures 7, 9:
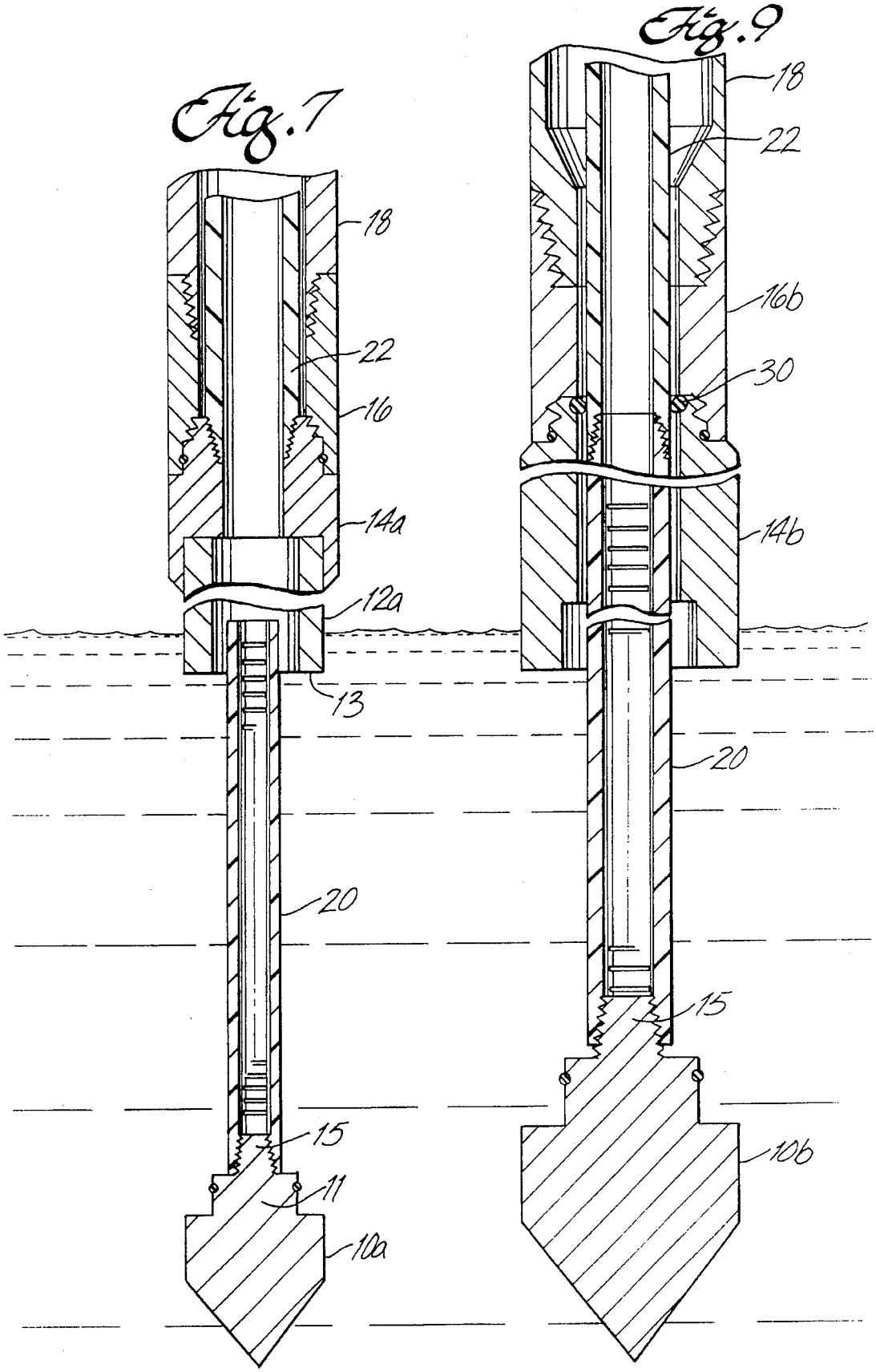
FIGS. 7 and 9 are schematic side elevation views of the embodiments of FIGS. 1 and 8, respectively, with the fluid passage sections exposed.

To introduce fluid into or out of the fluid passage section, the drive rod(s) 18 are raised, which in turn raises the sealing adapter 16*a* and collar 14*a* and the extension tube 12*a* to the position shown in FIG. 7. By raising the extension tube, fluid is allowed to enter or leave the interior of the device through perforations in pipe 20. As can be seen, this permits the extraction of a fluid sample through the drop pipe or the application of a vacuum force where the device is used for vacuum extraction. If a sample is to be taken, a suitable sampling device, as known to the art, is sent down the drop pipe. Alternatively, vacuum may be applied to extract the fluid, e.g. water or volatile organics, from the borehole and the ground surrounding the borehole in the vicinity of the fluid passage section of the device. In another alternative, fluid under pressure may be injected into the pipe for sparging purposes. The portion of the device from the collar down toward the drive point may be left in the ground along with the internal drop pipe. Similarly, the drop pipe itself may be fixed in position since it is connected to the sealing collar directly.

Figure 2:
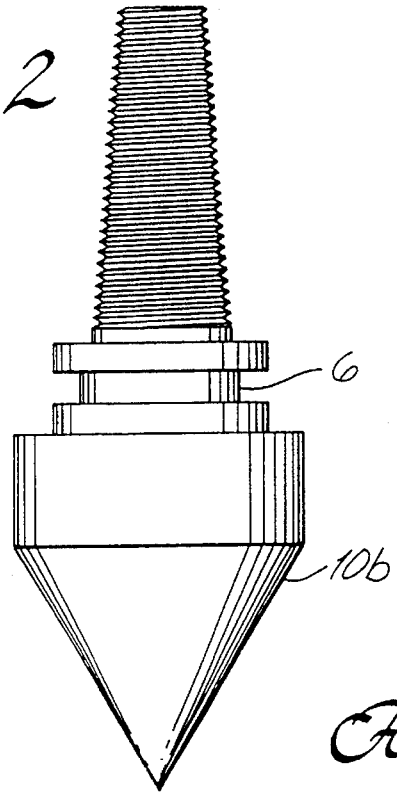
FIGS. 2, 3 and 4 are schematic side views of different embodiments of the drive point as it may be threaded to facilitate self-tapping of perforated plastic pipes.
Figure 3:
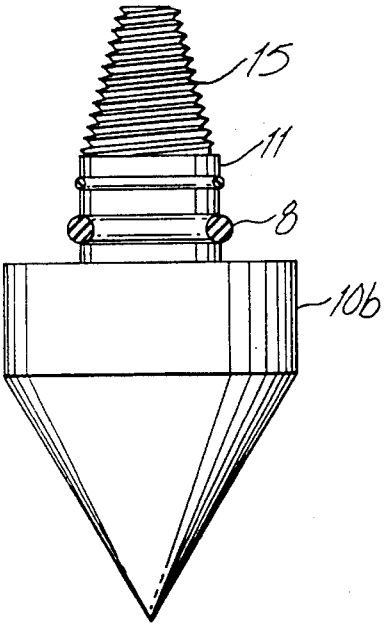

Alternative drive point configurations to those shown in FIG. 1 are shown in FIGS. 2–6. The drive point in FIG. 2 has a straight tapered stub designed to enable a plastic perforated pipe of varied internal diameter to self-tap and be secured to the drive point, as previously described. FIG. 2 and FIG. 3 show the same configuration with the groove 6, FIG. 2, and an "O" ring 8 shown in the groove in FIG. 3, to provide a seal between an extension tube such as 12*a* in FIG. 1 and the drive point 10*b* before the extension tube is raised to expose the fluid passage section, i.e. the perforated pipe 20 in this embodiment. An oversize groove can accommodate "O" rings of various thicknesses. In lieu of the tapered threads 15 shown in FIG. 3, the stub 11 may be provided with concentric barbs to fasten the pipe 20 to the drive point.

Figure 4:
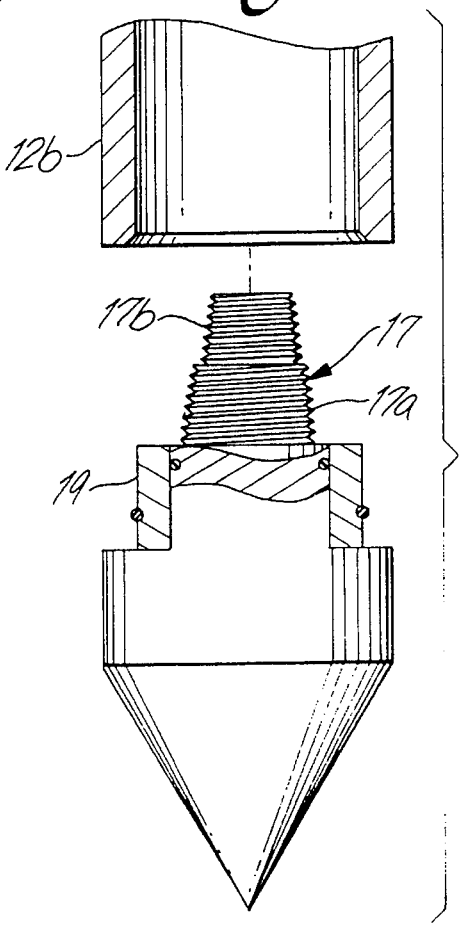

Another variation is the drive point shown in FIG. 4, which has a stepped threaded stub, designed to accommodate a still wider range of plastic pipe internal diameters which may be connected at 17*a* or 17*b*. This figure also shows the use of shims 19 that may be used to fit oversize extension tubes to the drive point.

Figure 5:
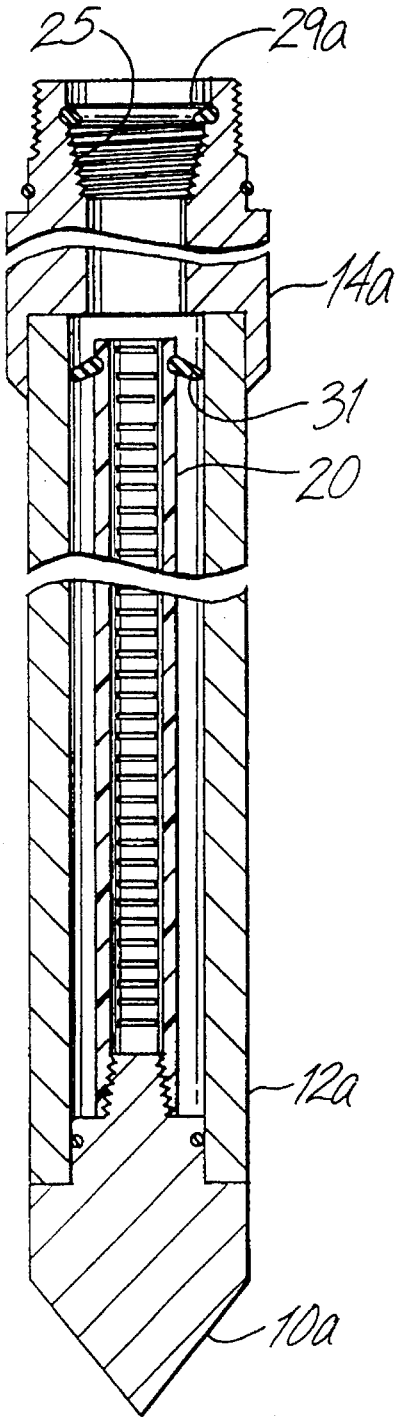
FIGS. 5 and 6 are schematic side views of different embodiments showing internally self-threading connectors for plastic drop pipes.
Figure 6:
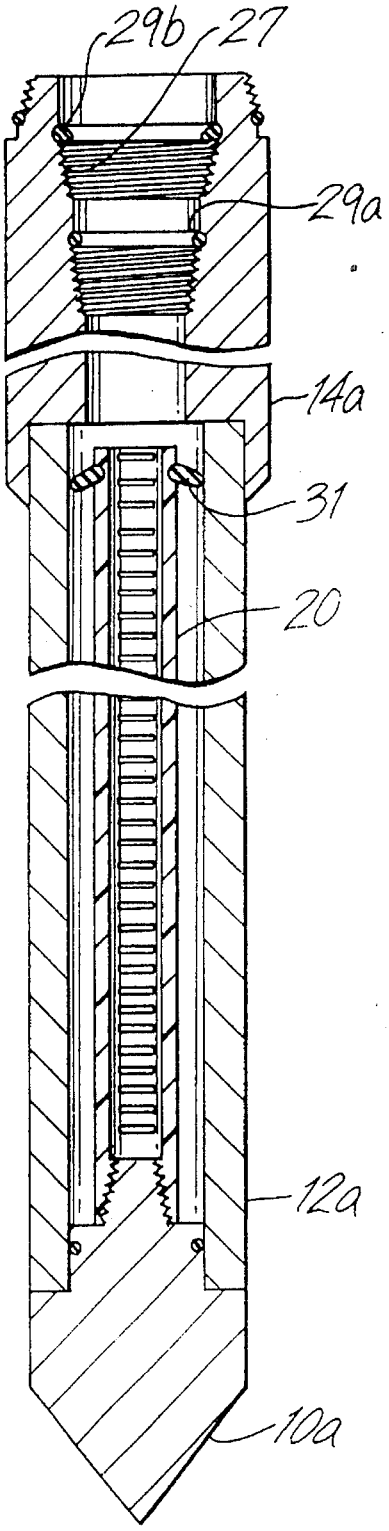

An alternative technique for joining the plastic drop pipe to the intake section is shown in FIGS. 5 and 6, where the annular sealing collar 14*a* is provided with internal threads, which may be a straight taper 25 as shown in FIG. 5 or a stepped taper 27 as shown in FIG. 6. Here too, the threads may facilitate the self-tapping of the plastic drop pipe and seals 29*a* and *b*, such as a cup seal, rod wiper or "O" ring, may be provided to seal the pipe and prevent contamination to the interior. If desired, a seal, e.g. a cup seal 31 (FIG. 5), can be provided at the top of the perforated pipe or screen to prevent fluid injected into the device from bypassing between the pipe and extension tube when the tube is raised. With the embodiments shown in FIGS. 5 and 6 the drop pipe is not connected directly to the perforated pipe, but is nonetheless in fluid-communicating relationship with the perforated pipe.

Figure 8:
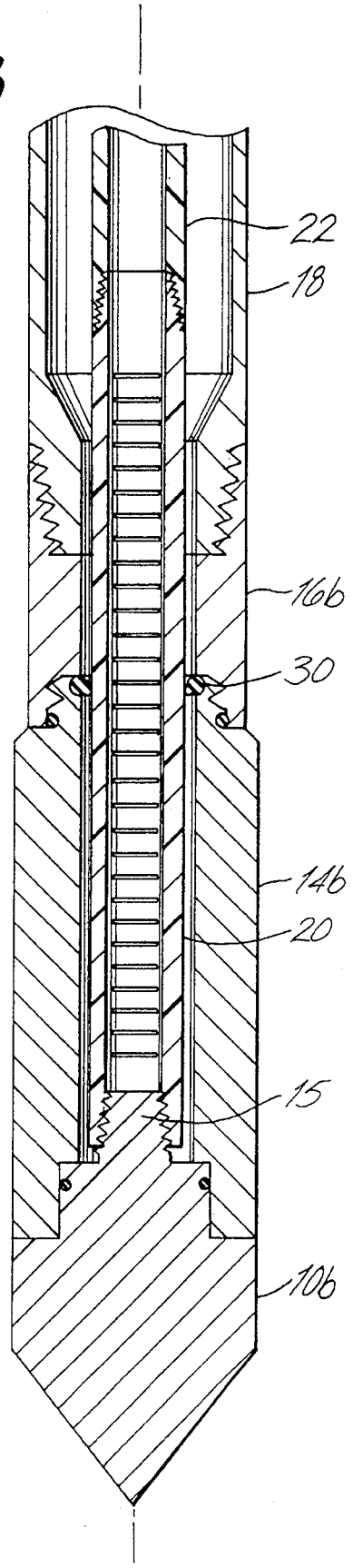
FIG. 8 is a schematic side elevation of another embodiment of the invention.

A variation of the embodiment of FIG. 1 is shown in FIG. 8. In this embodiment a similar drive point 10*b* is used, to which is connected a perforated pipe 20 by means of threaded tapered stub 15, and a drop pipe 22 is connected directly to the perforated pipe 20. However, an elongated annular sealing body 14*b* replaces the extension tube 12*a* and the sealing collar 14*a*, shown in FIG. 1, and performs the function of both. Thus, the sealing body 14*b* seals the device to the lateral surfaces of the borehole, just as does the collar 14*a* since it is also sized so that none of the other components of the device have a larger outside diameter.

In the embodiment of FIG. 8, an adapter 16*b* is connected to both the sealing body 14*b* and drive rod 18, as in FIG. 1, with opposite ends reverse-threaded. Therefore, the adapter 16*b* is removable with the drive rods 18 while leaving the sealing body 14*b* downhole with the drive point 10*b* and perforated tube 20.

Raising the drive rods as shown in FIG. 9 while in place causes the seal container body to be raised from the drive point, exposing the interior perforated pipe or screen so as to allow fluid to enter. A resilient seal such as a cup seal or "wiper" 30 is provided to seal to the outside surface of the drop pipe above the perforated pipe or screen when the seal container body is raised to a position where the cup seal contacts the solid drop pipe attached to the perforated pipe or screen. Once the seal container body is raised so that the cup seal is in contact with the drop pipe, the drive rod(s) may be removed for reuse, leaving the drop pipe sealed to the seal container body within the borehole. Fluid-sampling devices may be inserted or a vacuum may be applied or pressurized fluid for sparging may be introduced, as desired.

The resilient seal may be comprised of an internal gasket such as a rod wiper. However, any similar device may also be used to seal the outside diameter of the drop pipe instead of having an internal pipe threaded as shown in the previous embodiment. The drop pipe, which can be threaded directly onto the top of the screen, will slide through the seal, or alternatively the screen and drop pipe can be put into place after the power point device is driven into position in the ground but before opening the intake section.

The device of the present invention eliminates the need for long bodies to house the intake section, e.g. screen, since the screen can be disposed within the drive rods as the device is driven into position. In order to effect a substantial seal between the device and the lateral surfaces of the borehole, i.e. the surrounding ground, the sealing collar or sealing body should be the same diameter as the drive rod or larger.

Figure 10:
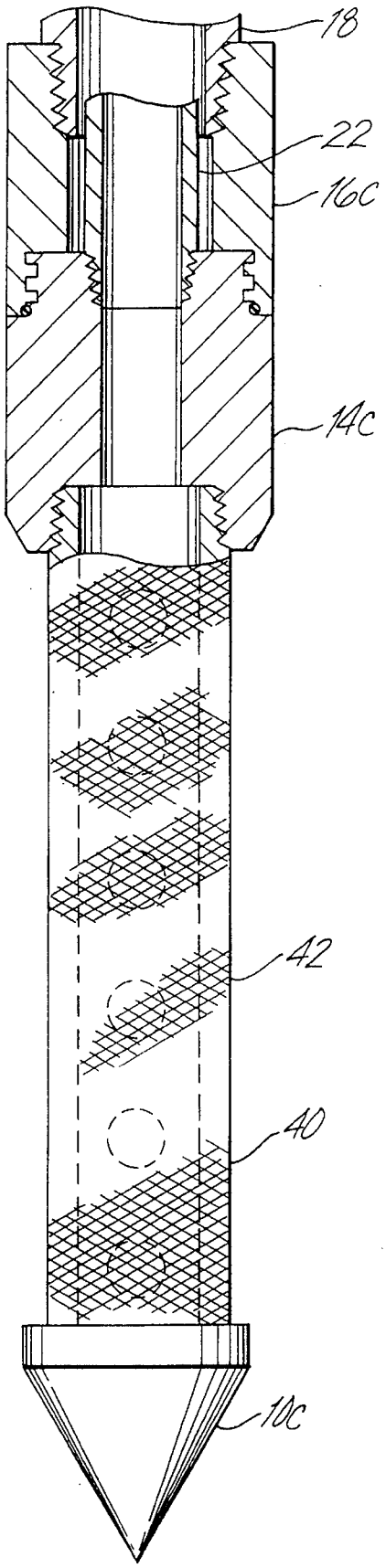
FIG. 10 is a schematic side elevation view of an additional embodiment of the invention.

FIG. 10 illustrates still another embodiment of the device and shows a drive point 10*c*, sealing collar 14*c* and adapter 16*c*. However, in this embodiment, a perforated heavy-walled pipe 40 replaces both the extension tube 12*a* and perforated pipe 20 in the embodiment shown in FIG. 1. Also, a cylindrical screen 42 is shown surrounding the pipe 40 to prevent debris from entering the pipe. The pipe is shown threadedly connected to the adapter but it may be welded or joined by any other suitable means. The collar 14*c* is threadedly connected, with reverse threads, to the adapter 16*c* so that the adapter can be removed with the drive rods after the device has been driven into place. At the opposite end, to the connection to the pipe 42, the collar is provided with internal threads, which may be as shown in FIGS. 5 and 6, to enable drop pipe 22 to connect to the collar 14*c* and be in fluid communication with the fluid passage section, e.g. perforated pipe 40. Drive rods may be connected to the adapter 16*c*, as shown.

In this configuration, after the drive rod 18 and adapter 16*c* are removed, the drop pipe 22 will remain attached to the collar 14*c* and in fluid-communicating relationship with the interior of the perforated pipe 40.

The FIG. 10 embodiment also shows how a standard drive point may be retrofitted with a collar to enjoy the benefits of the invention. The extension tube of FIG. 1 is replaced with the heavy-walled pipe 40 and is advantageously surrounded with a cylindrical screen 42 to prevent silt or other debris from clogging the perforated pipe 40, collar 14*c* and adapter 16*c* to facilitate the connection to the drive rod 18. The heavy-walled pipe is sturdy enough to enable the drive point to be driven into the ground by applying force to the driving rod connected to the sealing collar and/or adapter. For example, elements 10C, 40 and 42 would comprise a "standard drive point."

The collar is provided with threaded interior and threaded exterior sections, as previously described, and the adapter is threadedly connected to the collar and the annular drive rod is threadedly connected to the adapter. The threads connecting the adapter to the collar are opposite so that the adapter and drive rod can be released and removed from the collar by unscrewing the drive rod and releasing the adapter from the sealing collar. Alternatively, as discussed above, a segment of drive rod may be used as an adapter by oppositely threading the lower end to connect to the collar.

Although threaded connections between the heavy-walled pipe and the sealing collar are shown, it would also be possible to weld the two together if desired. In use, the drive point, heavy-walled pipe and screen remain in position in the ground after the adapter and drive rods have been removed following connection of the drop pipe to the sealing collar.

Figure 11:
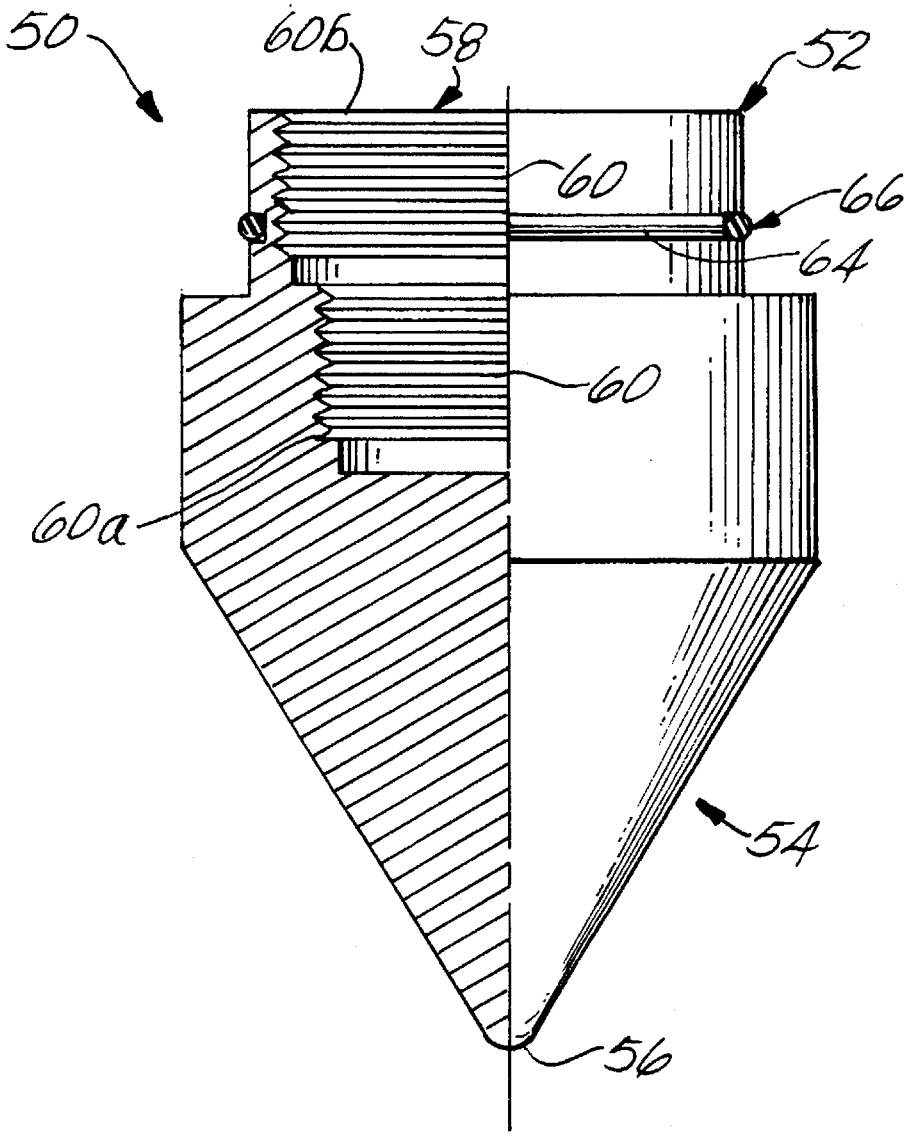
FIG. 11 is a schematic; partial cross-sectional side view of yet another embodiment of a drive point provided in accordance with practice of the present invention with internal threads to facilitate self-tapping of plastic pipes.

Turning to FIG. 11, there is shown yet another embodiment of a drive point 50 provided in accordance with practice of the present invention. The drive point 50 is used in the same manner as the drive point 10*a* associated with FIG. 1 and thus can be substituted therefor. The drive point 50 has a top end 52 and a bottom end 54. The bottom end 54 is shaped in the form of a cone, with a point 56 at its tip for penetrating the ground surface.

In contrast to the drive points shown in FIGS. 2–4, the drive point 50 has a generally cylindrical cavity 58 formed along its centerline through its top end 52. Tapered self-tapping threads 60 are machined or otherwise formed on the inside surface of the cavity. The threads are designed to self-thread onto the outside wall of a perforated plastic pipe or other drop pipe, such as the pipe 20 shown in FIG. 1.

In an exemplary embodiment, the threads are provided in two sets; a first set 60*a* formed deeper in the cavity, and a second set 60*b* adjacent the drive point top end 52. In one exemplary embodiment, the set of threads 60*a* is designed to be threaded onto a ¾-inch nominal outside diameter plastic pipe, while the upper set of threads 60*b* is designed to thread onto a 1-inch nominal size pipe. Of course, difference sets of thread sizes could be designed for threading onto pipes of sizes other than 1 inch and ¾ inch. Additionally, instead of providing the threads in two sets, the threads could be continuous all the way from the top surface to the thread farthest from the top surface or could be provided in three sets for use with pipes having three different outside diameters.

The outside diameter of standard PVC pipe is held to much tighter tolerances than the internal diameter, and the outside diameter does not vary with wall thickness. Thus, an advantage of the internally threaded drive point 50, as compared to drive points with external threads on stubs as shown in FIGS. 2–4, is that the internally threaded drive point can self-thread onto essentially all schedules (wall thicknesses) of standard PVC pipe sizes. Therefore, the internally threaded drive point 50 of this embodiment of the present invention can better accommodate PVC pipe with variable wall thickness than can the externally threaded drive points.

It has also been found that by using an internally threaded drive point, such as the drive point 50, fewer threads are needed to make a secure attachment than when drive points with threaded stubs are used. Furthermore, because a cavity is formed on the inside of the internally threaded drive points, the weight of the drive point is less than when solid drive points with externally threaded stubs are used. This reduction in weight makes the internally threaded drive point easier to handle and less expensive to ship than comparably sized externally threaded drive points.

The drive point 50 has a groove 64 around its outer surface into which an "O" ring 66 is seated to provide a seal between an extension tube, such as the tube 12*a* in FIG. 1, and the drive point before the extension tube is raised to expose the perforated pipe to which the drive point is connected. As was the case with the FIG. 3 embodiment, the groove 64 can be oversized to accommodate "O" rings of various thicknesses.

It is apparent from the foregoing that various changes and modifications may be made without departing from the invention. For example, a septum and septum-retaining means may be disposed at the top of the fluid-passage section, e.g. perforated pipe which may be penetrated by a probe sent down the drop pipe to extract a sample. Accordingly, the scope of the invention should be limited only by the appended claims, wherein what is claimed is:

1. A drive point comprising:

means disposed at one end of the drive point for penetrating the ground by application of force which causes said means to be driven or pushed into the ground; and a cavity formed in a top portion of the drive point at an end of the drive point opposite from the penetrating means, wherein said cavity has tapered self-tapping threads along a surface of the cavity for threadedly engaging a pipe.

2. A drive point according to claim 1 wherein the cavity is provided with at least two stepped tapered thread sets along the cavity surface to accommodate threaded connection between the thread sets and pipes of different outside diameters.

3. A drive point according to claim 1 wherein a circumferential groove is around the outer surface of the drive point, said groove being adapted to receive an "O" ring.

4. A device adapted to be driven into the ground to form a borehole, the device comprising:

a drive point having top and bottom ends, with means for penetrating the ground surface on its bottom end, said drive point having a cavity formed through a first portion of its top end, wherein said cavity has self-tapping threads on its surface for threadedly engaging a pipe;

a hollow fluid passage section having top and bottom ends, with the bottom end removably engaged to a second portion of the top end of the drive point, said hollow fluid passage section having an annular sealing collar with a bore therethrough on its top end, said annular sealing collar having top and bottom ends; and a hollow annular drive rod having top and bottom ends, the bottom end of the drive rod releasably connected to the top end of the annular sealing collar, wherein said sealing collar is sized with respect to the borehole to substantially seal the collar to the ground when the device is in the borehole.

5. A device according to claim 4 further comprising an annular adapter with a bore therethrough and having top and bottom ends, wherein the top end of said adapter is directly connected to the drive rod and the bottom end of said adapter is releasably connected to the annular sealing collar.

6. A device according to claim 4 additionally comprising means located on the interior of the hollow fluid passage section for allowing fluid to enter or leave an interior portion of the device at a location below the annular sealing collar.

7. A device according to claim 6 wherein said means for allowing fluid to enter or leave the interior portion of the device comprises a perforated pipe with top and bottom ends, with the bottom end of said perforated pipe threadedly attached to the threaded drive point cavity.

8. A device according to claim 5 further comprising means for introducing fluid into the device under pressure or withdrawing fluid through the device under vacuum.

9. A device according to claim 5 wherein the top end of said annular adapter is threadedly connected to the bottom end of the drive rod, and the bottom end of the adapter is threadedly connected to the top end of the sealing collar, wherein the threaded connection of the drive rod to said adapter and the threaded connection of the adapter to the sealing collar are oppositely threaded so that said drive rod and adapter can be released from the sealing collar by rotating the drive rod to thereby unscrew the adapter from the sealing collar.

10. A device according to claim 5 wherein the sealing collar is internally threaded at its top end and a drop pipe is threadedly connected to the internal threads of the sealing collar.

11. A device according to claim 10 wherein said internal threads of the collar are tapered to accommodate drop pipes of different external diameters.

12. A device according to claim 10 wherein the collar is provided with at least two stepped tapered threaded sections of different diameters to accommodate drop pipes of different external diameters.

13. A device according to claim 4 wherein the drive point cavity has at least two stepped tapered self-tapping thread sets to accommodate pipes of different outside diameters.

14. A device adapted to be driven into the ground to form a borehole, the device comprising:

a drive point having top and bottom ends, with means for penetrating the ground surface on its bottom end, said drive point having a cavity formed through a first portion of its top end, wherein said cavity includes self-tapping threads on its surface for threadedly engaging a pipe;

an extension tube having top and bottom ends, wherein the extension tube bottom end is removably connected to a second portion of said top end of the drive point;

an annular sealing collar with a bore therethrough and having top and bottom ends, wherein the sealing collar bottom end is connected to the extension tube top end, said sealing collar being sized with respect to the borehole to substantially seal the collar to the ground when the device is in place in the borehole;

an annular adapter with a bore therethrough and having top and bottom ends, wherein the adapter bottom end is releasably connected to the top end of the sealing collar;

a hollow annular drive rod having top and bottom ends, wherein the drive rod bottom end is connected to the top end of the adapter;

a perforated pipe having top and bottom ends disposed within the extension tube, wherein the bottom end of the perforated pipe is threaded into the threaded drive point cavity; and a drop pipe disposed within the adapter and sealing collar and in fluid communication with the perforated pipe.

15. A device according to claim 14 wherein said drive rod is threadedly connected to said adapter and said adapter is oppositely threadedly connected to said sealing collar and is removable therefrom by rotating the drive rod, which thereby unscrews the adapter from the sealing collar without separating the adapter from the drive rod.

16. A device according to claim 15 wherein said adapter is oppositely threaded on its top and bottom ends.

17. A device according to claim 15 wherein said drive rod is threadedly connected to said adapter and said adapter is threadedly connected to said sealing collar, said threaded connections of the drive rod to the adapter being opposite to the threaded connection of the adapter to the sealing collar so that said drive rod and adapter can be released from the sealing collar by rotating the drive rod without releasing the adapter from the drive rod.

18. A device according to claim 14 wherein the drive point cavity has at least two stepped tapered self-tapping thread sets to accommodate pipes of different outside diameters.

19. A device adapted to be driven into the ground to form a borehole, the device comprising:

a drive point having top and bottom ends, with means to penetrate the ground surface on its bottom end, said drive point having a cavity formed through a first portion of its top end, wherein said cavity includes self-tapping threads on its surface for threadedly engaging a perforated pipe;

a hollow sealing body extending upwardly from said drive point, said sealing body having top and bottom ends, wherein said bottom end of the sealing body is engaged to a second portion of the top end of the drive point, and wherein the sealing body is sized with respect to the borehole to substantially seal the sealing body to the ground when said device is in the borehole;

a hollow annular drive rod;

an annular adapter with a bore therethrough, said adapter threadedly connected at its lower end to the top end of the sealing body and threadedly connected at its opposite end to the drive rod, said threaded connections being oppositely threaded so that said drive rod and adapter can be removed from the sealing body by rotating the drive rod without releasing the adapter from the drive rod;

a perforated pipe disposed within said sealing body, said perforated pipe having top and bottom ends, with the pipe's bottom end threaded into the threaded surface of the drive point cavity;

a drop pipe within said drive rod in fluid communication with said perforated pipe; and an annular resilient seal means for sealing around the outer surface of the drop pipe when the drive rod and sealing body are raised to expose the perforated pipe to fluids within the borehole.

20. A device according to claim 19 wherein said annular resilient seal means is attached to and extends around an inner surface of said sealing body.

21. A device according to claim 19 wherein the resilient seal is an "O" ring.

22. A device according to claim 20 wherein said seal means is selected from the group consisting of an "O" ring, a cup seal and a rod wiper.

23. A device according to claim 19 wherein the drive point cavity has at least two stepped tapered self-tapping thread sets to accommodate pipes of different outside diameters.

* * * * *